US006481244B1

(12) United States Patent
Wright

(10) Patent No.: US 6,481,244 B1
(45) Date of Patent: Nov. 19, 2002

(54) RING PROTECTING DEVICE

(76) Inventor: Carlos D. Wright, 4232 Chinaberry La., Angier, NC (US) 27501

( * ) Notice: Subject to any disclaimer, the term of this patent is extended or adjusted under 35 U.S.C. 154(b) by 77 days.

(21) Appl. No.: 09/671,895

(22) Filed: Sep. 28, 2000

(51) Int. Cl.[7] ..... A44C 19/00

(52) U.S. Cl. ..... 63/15.8; 63/15; 63/15.6; 63/3

(58) Field of Search ..... 63/15, 15.45, 15.5, 63/15.6, 15.8, 3, 3.1; 277/370, 606, 910

(56) References Cited

U.S. PATENT DOCUMENTS

| | | | | | |
|---|---|---|---|---|---|
| 613,243 | A | | 11/1898 | Carroll et al. | |
| 1,488,321 | A | * | 3/1924 | De Witt | 138/137 |
| 1,533,441 | A | | 4/1925 | Melling | |
| 1,885,930 | A | | 11/1932 | Lowy | |
| 2,048,317 | A | * | 7/1936 | Berman | 63/15.8 |
| 2,542,405 | A | * | 2/1951 | Fink | 384/270 |
| 3,086,529 | A | * | 4/1963 | Munz et al. | 606/203 |
| 3,214,939 | A | * | 11/1965 | Monahan | 63/15.6 |
| 3,745,788 | A | * | 7/1973 | Sulivan | 63/15.6 |
| 4,377,079 | A | | 3/1983 | Krueger | |
| 4,713,947 | A | * | 12/1987 | Collins et al. | 66/1 A |
| 4,845,777 | A | | 7/1989 | Mersinas | |
| D337,543 | S | | 7/1993 | Caldow | |
| 5,628,208 | A | * | 5/1997 | Rood | 63/15.6 |

* cited by examiner

*Primary Examiner*—J. J. Swann
*Assistant Examiner*—Andrea Chop

(57) ABSTRACT

A ring protecting device for covering and protecting outer surface of a ring. The ring protecting device includes an annular member. The annular member has a first edge, a second edge, an inner surface and an outer surface. A panel is securely attached to and extending around the inner surface of the annular member. The panel is positioned between the first and second edges. The panel comprises a cloth material. The annular member is positioned around the ring such that the panel abuts the ring.

5 Claims, 3 Drawing Sheets

RING PROTECTING DEVICE

BACKGROUND OF THE INVENTION

1. Field of the Invention

The present invention relates to ring guards and more particularly pertains to a new ring protecting device for covering and protecting outer surface of a ring.

2. Description of the Prior Art

The use of ring guards is known in the prior art. More specifically, ring guards heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,377,079; 1,885,930; 1,533,441; U.S. Des. Patent No. 337,543; U.S. Pat. No. 4,845,777; and U.S. Des. Patent No. 613,243.

While these devices fulfill their respective, particular objectives and requirements, the aforementioned patents do not disclose a new ring protecting device. The inventive device includes an annular member. The annular member has a first edge, a second edge, an inner surface and an outer surface. A panel is securely attached to and extending around the inner surface of the annular member. The panel is positioned between the first and second edges. The panel comprises a cloth material. The annular member is positioned around the ring such that the panel abuts the ring.

In these respects, the ring protecting device according to the present invention substantially departs from the conventional concepts and designs of the prior art, and in so doing provides an apparatus primarily developed for the purpose of covering and protecting outer surface of a ring.

SUMMARY OF THE INVENTION

In view of the foregoing disadvantages inherent in the known types of ring guards now present in the prior art, the present invention provides a new ring protecting device construction wherein the same can be utilized for covering and protecting outer surface of a ring.

The general purpose of the present invention, which will be described subsequently in greater detail, is to provide a new ring protecting device apparatus and method which has many of the advantages of the ring guards mentioned heretofore and many novel features that result in a new ring protecting device which is not anticipated, rendered obvious, suggested, or even implied by any of the prior art ring guards, either alone or in any combination thereof.

To attain this, the present invention generally comprises an annular member. The annular member has a first edge, a second edge, an inner surface and an outer surface. A panel is securely attached to and extending around the inner surface of the annular member. The panel is positioned between the first and second edges. The panel comprises a cloth material. The annular member is positioned around the ring such that the panel abuts the ring.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ring protecting device apparatus and method which has many of the advantages of the ring guards mentioned heretofore and many novel features that result in a new ring protecting device which is not anticipated, rendered obvious, suggested, or even implied by any of the prior art ring guards, either alone or in any combination thereof.

It is another object of the present invention to provide a new ring protecting device which may be easily and efficiently manufactured and marketed.

It is a further object of the present invention to provide a new ring protecting device which is of a durable and reliable construction.

An even further object of the present invention is to provide a new ring protecting device which is susceptible of a low cost of manufacture with regard to both materials and labor, and which accordingly is then susceptible of low prices of sale to the consuming public, thereby making such ring protecting device economically available to the buying public.

Still yet another object of the present invention is to provide a new ring protecting device which provides in the apparatuses and methods of the prior art some of the advantages thereof, while simultaneously overcoming some of the disadvantages normally associated therewith.

Still another object of the present invention is to provide a new ring protecting device for covering and protecting outer surface of a ring.

Yet another object of the present invention is to provide a new ring protecting device which includes an annular member. The annular member has a first edge, a second edge, an inner surface and an outer surface. A panel is securely attached to and extending around the inner surface of the annular member. The panel is positioned between the first and second edges. The panel comprises a cloth material. The annular member is positioned around the ring such that the panel abuts the ring.

Still yet another object of the present invention is to provide a new ring protecting device that has a cover portion thereon for covering the a stone mounted in the ring.

Even still another object of the present invention is to provide a new ring protecting device that has a cloth panel therein for cleaning and protecting the ring.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
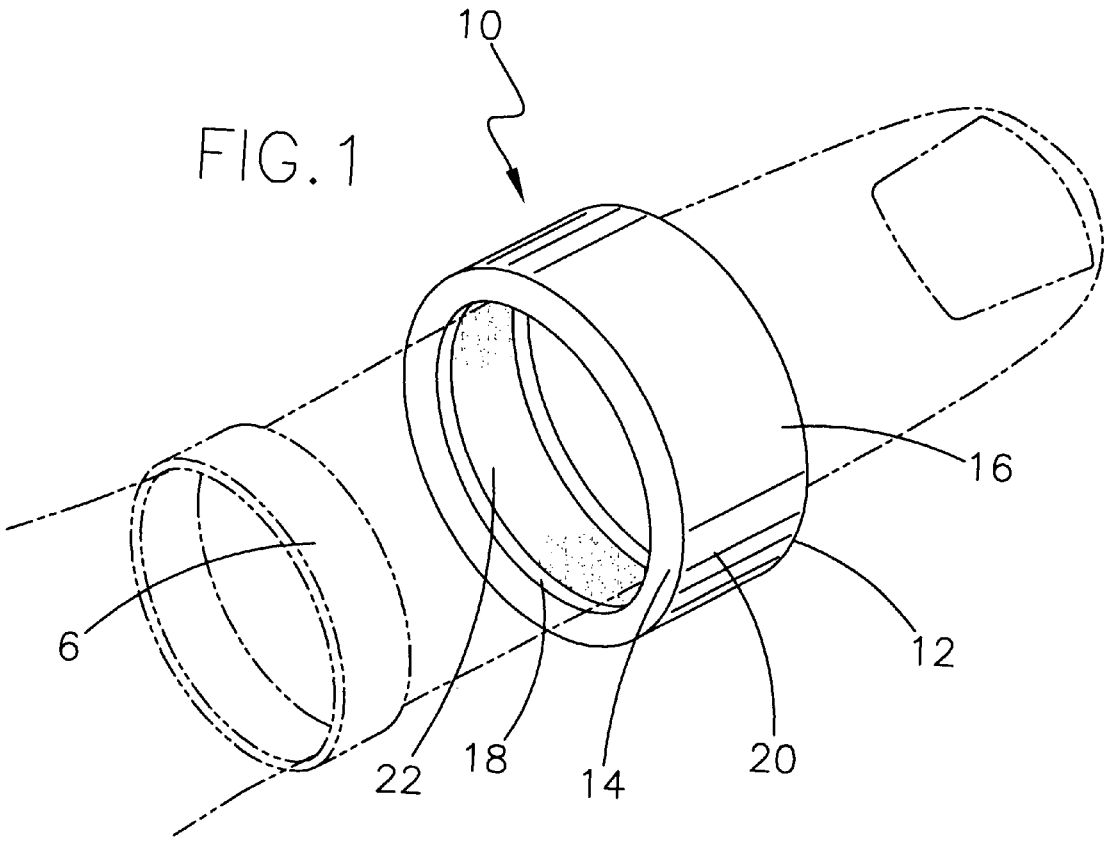
FIG. 1 is a schematic perspective view of a new ring protecting device according to the present invention.
Figure 2:
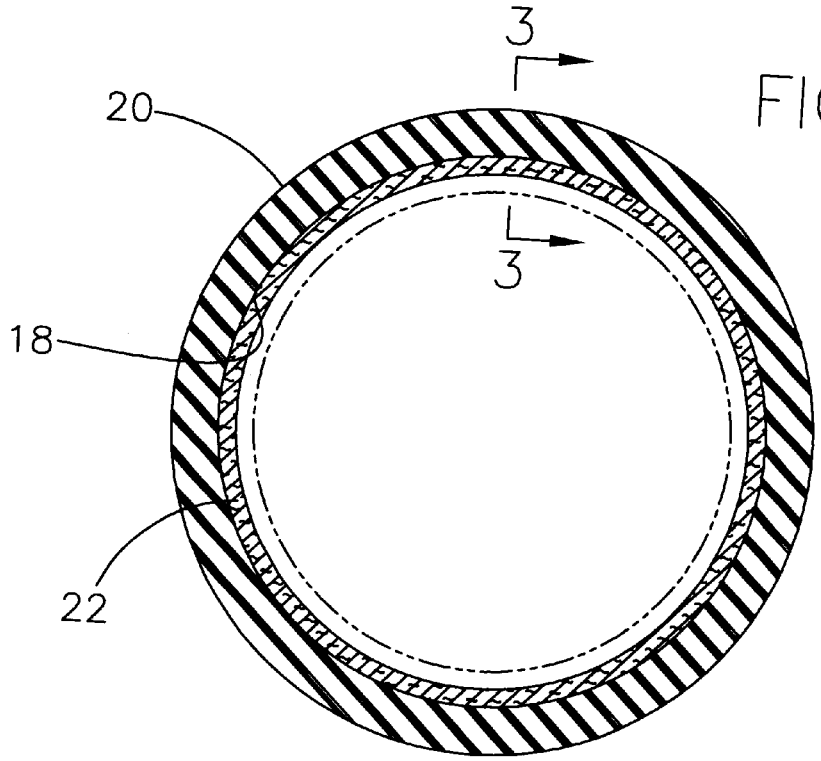
FIG. 2 is a schematic side view of the present invention.
Figure 3:
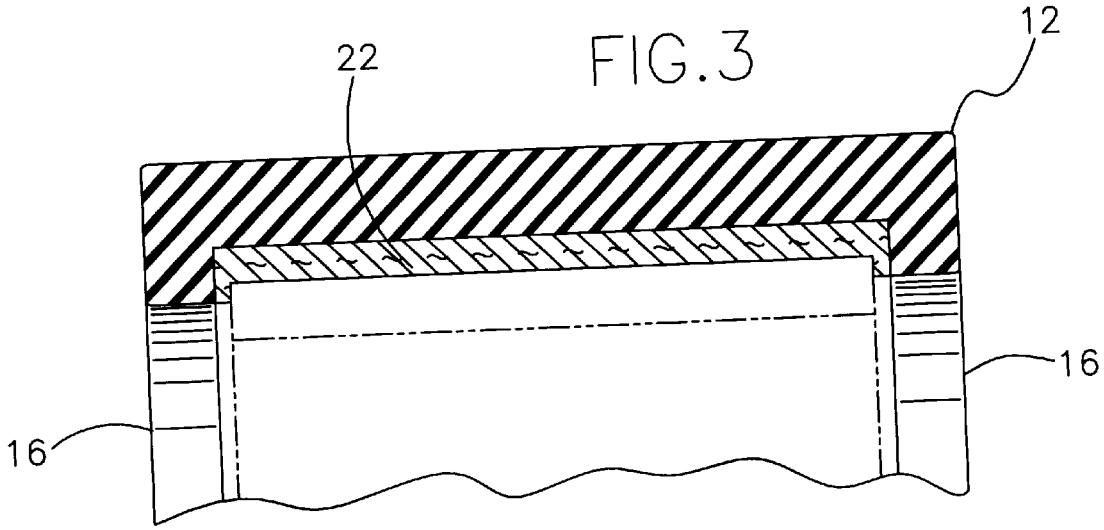
FIG. 3 is a schematic cross-sectional view taken along line 3—3 of the present invention.
Figure 4:
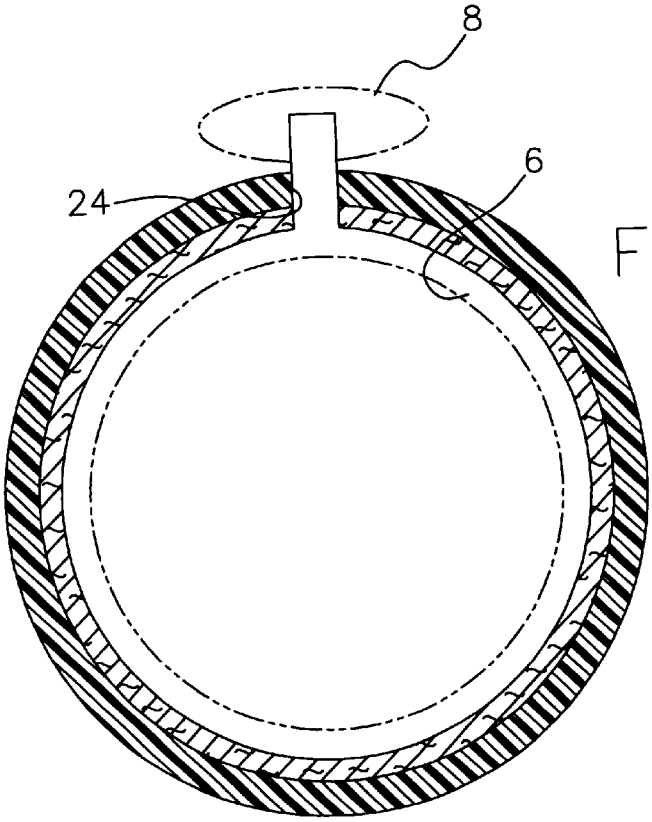
FIG. 4 is a schematic cross-sectional view of the present invention.

With reference now to the drawings, and in particular to FIGS. 1 through 6 thereof, a new ring protecting device embodying the principles and concepts of the present invention and generally designated by the reference numeral 10 will be described.

As best illustrated in FIGS. 1 through 6, the ring protecting device 10 generally comprises an annular member 12. The annular member 12 has a first edge 14, a second edge 16, an inner surface 18 and an outer surface 20. The annular member 12 is preferably comprised of a plastic or an elastomeric material.

A panel 22 is securely attached to and extends around the inner surface 18 of the annular member 12. The panel 22 is positioned between the first 14 and second 16 edges. The panel 22 preferably comprises a cloth material and is ideally a cloth material of the type conventionally used to clean jewelry.

The annular member preferably has a first break 24 therein. The first break 24 extends through the annular member 12 and the panel 22 to define a pair of opposed edges 26, 28. A fastening means removably fastens the opposed edges together consists of a bore 30 and a protruding member 32. A first of the edges 26 has the bore 30 therein. The bore 30 has a wall having an annular shoulder 34 therein. The second edge 28 has the protruding member 32 integrally coupled thereto and positioned to generally correspond with the bore 30. The protruding member 32 has a flange 36 thereon for releasably engaging the annular shoulder 34 in the bore 30.

Figure 5:
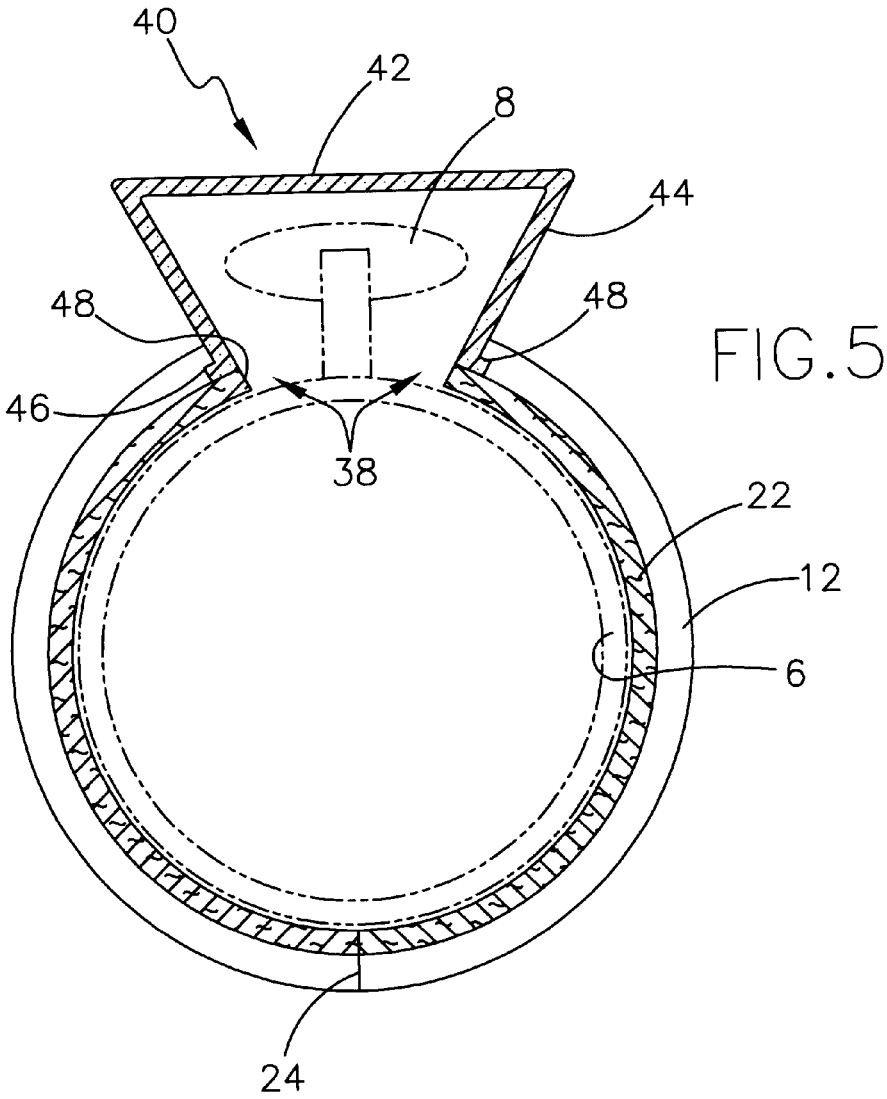
FIG. 5 is a schematic cross-sectional view of the second embodiment of the present invention.
Figure 6:
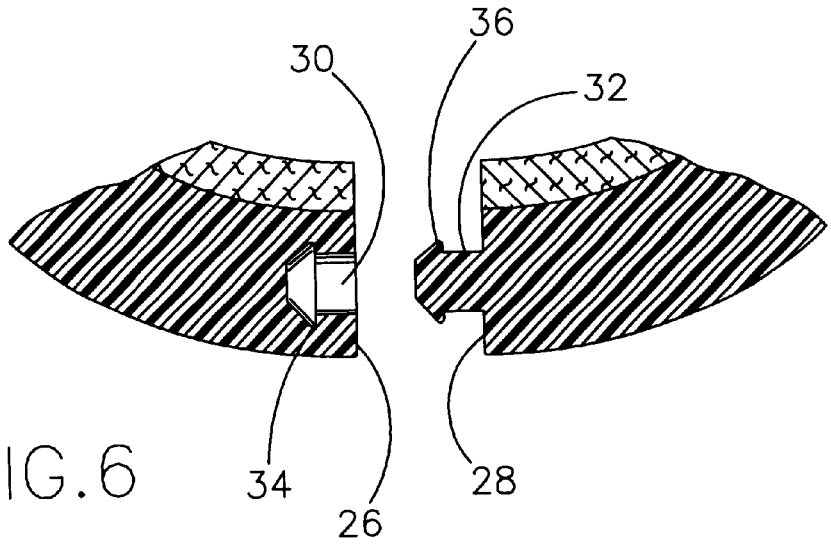
FIG. 6 is a schematic exploded cross-sectional view of the fastening means of the present invention.

The second embodiment, shown in FIG. 5, has a second break 38 in the annular member 12 that is generally diametrically opposed to the first break 24. The second break 38 extends through the annular member 12 and the panel 22 for placement of a stone 8 mounted on a ring 6.

A cover portion 40 for covering the stone 8 has a top wall 42. A peripheral side wall 44 extends downwardly from and is integrally coupled to a periphery of the top wall 42. The peripheral side wall 44 has a bottom edge 46. Each of a pair of opposite edges 48 of the annular member 12 defined by the second break is securely attached to the bottom edge 46 of the peripheral side wall 44 and positioned on opposite sides of the cover portion 40. The cover portion 40 extends away from the annular member 12 such that the stone 8 may be positioned in the cover portion 40 when the annular member 12 is positioned around the ring 6. The cover portion 40 preferably comprises a generally transparent material, which is ideally a plastic.

In use, the user slides the annular member 12 over their ring 6 or they open up the first break 24 to place the annular member 12 around their ring 6. If the user has a stone 8 mounted in or on the ring 6, the cover portion 40 is placed over the stone 8 and the first break 24 is then coupled together using the bore 30 and protruding member 32.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ring protecting device for removably placing over a ring, said device comprising:

an annular member, said annular member having a first edge, a second edge, an inner surface and an outer surface;

a panel, said panel being securely attached to and extending around said inner surface of said annular member, said panel being positioned between said first and second edges, said panel comprising a cloth material; and wherein said annular member is adapted to be positioned around the ring such that said panel can abut the ring;

said annular member having a first break therein, said first break extending through said annular member and said panel to define a pair of opposed edges; and a first one of said pair of opposed edges having a bore therein, said bore having a wall having an annular shoulder therein, said second edge having a protruding member integrally coupled thereto and positioned to generally correspond with said bore, said protruding member having a flange thereon for releasably engaging said annular shoulder in said bore.

2. A ring protecting device for removably placing over a ring, said ring having a stone securely mounted thereon, said device comprising:

an annular member, said annular member having a first edge, a second edge, an inner surface and an outer surface;

a panel, said panel being securely attached to and extending around said inner surface of said annular member, said panel being positioned between said first and second edges, said panel comprising a cloth material;

said annular member having a first break therein, said first break extending through said annular member and said panel to define a pair of opposed edges;

said annular member having a second break therein, said second break being generally diametrically opposed to said first break, said second break extending through said annular member and said panel;

wherein said stone is positionable between opposite edges of said second break; and a cover portion, said cover portion having a top wall, a peripheral side wall extending downwardly from and being integrally coupled to a periphery of said top wall, said peripheral side wall having a bottom edge, each of a pair of opposite edges of said annular member defined by said second break being securely attached to said bottom edge of said peripheral side wall and positioned on opposite sides of said cover portion, said cover portion extending away from said annular member such that said stone may be positioned in said cover portion when said annular member is positioned around said ring.

3. The ring protecting device as in claim 2, wherein said annular member comprises:

a first of said edges defined by said first break having a bore therein, said bore having a wall having an annular shoulder therein, said second edge defined by said first break having a protruding member integrally coupled thereto and positioned to generally correspond with said bore, said protruding member having a flange thereon for releasably engaging said annular shoulder in said bore.

4. The ring protecting device as in claim 2, further comprising:

a fastening means for removably fastening together said pair of opposed edges.

5. A ring protecting device for removably placing over a ring, said ring having a stone securely mounted thereon, said device comprising:

an annular member, said annular member having a first edge, a second edge, an inner surface and an outer surface, said annular member comprising a plastic material;

a panel, said panel being securely attached to and extending around said inner surface of said annular member, said panel being positioned between said first and second edges, said panel comprising a cloth material;

said annular member having a first break therein, said first break extending through said annular member and said panel to define a pair of opposed edges, a first one of said pair of opposed edges having a bore therein, said bore having a wall having an annular shoulder therein, said second edge having a protruding member integrally coupled thereto and positioned to generally correspond with said bore, said protruding member having a flange thereon for releasably engaging said annular shoulder in said bore;

said annular member having a second break therein, said second break being generally diametrically opposed to said first break, said second break extending through said annular member and said panel;

a cover portion, said cover portion having a top wall, a peripheral side wall extending downwardly from and being integrally coupled to a periphery of said top wall, said peripheral side wall having a bottom edge, each of a pair of opposite edges of said annular member defined by said second break being securely attached to said bottom edge of said peripheral side wall and positioned on opposite sides of said cover portion, said cover portion extending away from said annular member such that said stone may be positioned in said cover portion when said annular member is positioned around said ring, said cover portion comprising a generally transparent material, said transparent material comprising a plastic.

* * * * *